United States Patent [19]

Yoshitake et al.

[11] 4,276,153

[45] Jun. 30, 1981

[54] PROCESS FOR THERMAL CRACKING OF HYDROCARBONS AND APPARATUS THEREFOR

[75] Inventors: Masami Yoshitake, Sakai; Fumiaki Yamaguchi, Iwakuni, both of Japan

[73] Assignees: Mitsui Engineering and Shipbuilding Co., Ltd.; Mitsui Petrochemical Industries, Ltd., both of Tokyo, Japan

[21] Appl. No.: 108,583

[22] Filed: Dec. 31, 1979

[30] Foreign Application Priority Data

Jan. 6, 1979 [JP] Japan ..... 54-875

[51] Int. Cl.[3] ..... C10G 9/16; C10G 9/34

[52] U.S. Cl. ..... 208/48 Q; 196/118; 208/95; 208/125

[58] Field of Search ..... 208/125, 48 Q, 95, 100; 196/118, 98, 110, 122; 422/204, 206, 207

[56] References Cited

U.S. PATENT DOCUMENTS

| | | | |
|---|---|---|---|
| 1,948,345 | 2/1934 | Garafolo | 208/125 |
| 3,210,268 | 10/1965 | Hendal et al. | 208/125 |
| 3,252,774 | 5/1966 | McMahon et al. | 48/214 R |
| 4,012,457 | 3/1977 | Bredeson et al. | 208/125 |

FOREIGN PATENT DOCUMENTS

| | | |
|---|---|---|
| 1357495 | 6/1974 | United Kingdom . |
| 1552511 | 8/1977 | United Kingdom . |
| 2016511 | 9/1979 | United Kingdom . |

*Primary Examiner*—T. M. Tufariello

*Attorney, Agent, or Firm*—Armstrong, Nikaido, Marmelstein & Kubovcik

[57] ABSTRACT

A process for the thermal cracking of hydrocarbons by feeding them into a line together with a fused salt, which comprises: feeding a fused salt mixed with steam into a reaction tube of a thermal cracking furnace of external heating type and further feeding raw hydrocarbons mixed with steam into said reaction tube to thermally crack the raw hydrocarbons; quenching the resulting fluid mixture of the cracking products, fused salt and steam in a quenching device, then dividing the fluid mixture into the fused salt and a gaseous substance, removing sludge and, if necessary, sulfur compounds from thus separated fused salt and recirculating the fused salt to the reaction tube and the quenching device; and dividing thus separated gaseous substance into an oil containing coke, tarry substances and fused salt mist and the intended cracking gas, and subjecting the oil to treatment with steam to convert the coke and tarry substance in the oil into water gas or to partial burning treatment with air or oxygen to divide the same into a useful gas, oil and the fused salt and thereby recovering them.

11 Claims, 3 Drawing Figures

FIG.I

PROCESS FOR THERMAL CRACKING OF HYDROCARBONS AND APPARATUS THEREFOR

BACKGROUND OF THE INVENTION

The present invention relates to a process for the thermal cracking of hydrocarbons contained in raw oils and an apparatus therefor. More particularly, the present invention relates to a process for the thermal cracking of hydrocarbons with a fused salt and steam to obtain lower olefins such as ethylene and propylene, and an apparatus therefor.

Olefin gases such as ethylene and propylene used as fundamental starting materials in the petroleum chemical industry have been produced by thermal cracking of light hydrocarbons such as naphtha using, for example, a tubular furnace of external heating type. It has been known that in the process wherein the tubular furnace of external heating type is used, coke is by-produced and thereby deposits in the device to cause troubles even though the light hydrocarbons are used. The troubles are serious when hydrocarbons such as kerosine, gas oil, heavy oil, asphalt oil and crude oil are thermally cracked by this process and it is difficult to put this process to practical use.

In the production of lower olefins by cracking ethane and naphtha, those raw hydrocarbons are mixed with steam and introduced into a reaction tube of cracking furnace. The fluid mixture is heated by plural burners arranged on the wall of the cracking furnace and thereby cracked to form a gas rich in lower olefins.

The cracking gas discharged from the reaction tube of cracking furnace is quenched in a quench heat exchanger in order to inhibit undesirable reaction such as polymerization reaction. One of defects caused in such an apparatus is that tars and coke by-produced by the thermal cracking of the raw hydrocarbons deposit in the reaction tube of the cracking furnace, heat transfer pipe of the quench heat exchanger and pipes connecting them to cause so-called coking phenomenon. Therefore, after continuation of the operation for a long period of time, they are accumulated on the tubular walls, whereby wall temperatures of the reaction tube of the cracking furnace and heat-transfer pipes of the quench heat exchanger are elevated to invite pressure loss and reduction in heat transfer efficiency. Consequently, the feeding of the raw hydrocarbons must be stopped to remove the deposits at regular intervals. In case hydrocarbon fractions such as crude oil, kerosine, gas oil, heavy oil and asphalt oil are cracked by this process, tar and coke deposits are by-produced in far larger amounts than those by-produced in case of using light hydrocarbon materials such as ethane and naphtha to make the long period operation of the apparatus utterly impossible.

Though the process for the thermal cracking of raw oils in the reaction tube of external heating type has the defects as above described, it has been attempted to thermally crack hydrocarbons using a fused salt or a fused metal as heat transfer medium (see, for example, the specifications of Japanese Patent Publications Nos. 29824/1964 and 5656/1963 and U.S. Pat. No. 3,252,774). However, according to those processes wherein heat of reaction required for the thermal cracking of hydrocarbons is furnished by sensible heat of the fused salt or fused metal, a large amount of the fused salt or fused metal of a high temperature must be kept in the system. This is unfavorable from the viewpoint of safety. Further, difficulties cannot be avoided in the design of the apparatus and also in the operations such as starting up and shutting down, since a large amount of the fused salt or fused metal is circulated in the reaction zone, regeneration zone and heating zone.

More particularly, processes for preventing coke deposition on the inner walls of the thermal cracking reaction tube or indirect heat exchanger by means of the molten metal are disclosed in Japanese Patent Publications Nos. 19244/1972, 8711/1975 and 41027/1974. However, in those processes, considerations are taken only of wetting property of the fused metal, structure of an inlet for the fused metal and materials of the inner walls. They are silent on effective amount of the fused metal, though amount of by-produced coke is varied depending on raw hydrocarbons used. Thus, they are unfavorable from viewpoints of economization, operation capacity and safety.

SUMMARY OF THE INVENTION

The basic object of the present invention is to provide a process and apparatus for continuous thermal cracking of a hydrocarbon-containing raw oil in a reaction tube of external heating type without causing clogging due to coke deposition in the device.

Another object of the present invention is to provide a process and an apparatus for thermal cracking of hydrocarbons safely and easily.

Still another object of the present invention is to provide a process and an apparatus for thermal cracking of hydrocarbons, particularly heavy hydrocarbons, efficiently with a fused salt and steam in a tubular thermal cracking furnace of external heating type.

A further object of the present invention is to provide a process and apparatus for the production of olefins in a high yield, which make it possible to thermally crack the hydrocarbons in an externally heated tubular furnace of a shorter residence time type, safely, substantially without causing by-production of coke and thereby without causing clogging of the device, wherein the amount of the fused salt is small and the device is not corroded.

The above objects can be attained by the process for the thermal cracking of hydrocarbons by feeding a fused salt according to the present invention. The process of the invention is characterized by feeding a fused salt mixed with steam into a reaction tube of a thermal cracking furnace of external heating type and further feeding raw hydrocarbons mixed with steam into said reaction tube to thermally crack the raw hydrocarbons; quenching the resulting fluid mixture of the cracking products, fused salt and steam in a quenching device, then dividing the fluid mixture into the fused salt and a gaseous substance, removing sludge and, if necessary, sulfur compounds from thus separated fused salt, recirculating the fused salt to the reaction tube and the quenching device; and dividing thus separated gaseous substance into an oil containing coke, tarry substances and fused salt mist and the intended cracking gas, subjecting the oil to treatment with steam to convert the coke and tarry substance in the oil into water gas or to partial burning treatment with air or oxygen to divide the same into a useful gas, oil and the fused salt, and thereby recovering them.

The apparatus of the present invention for the thermal cracking of hydrocarbons is characterized by fundamentally comprising a tubular thermal cracking furnace of external heating type having a fused salt mixing zone in which steam is mixed with fused salt and a raw hydrocarbon mixing zone in which a fluid mixture of steam and fused salt is mixed with the raw hydrocarbons, a quenching device for cooling a mixture of the cracking products, fused salt and steam, a fused salt-separating device for separating the fused salt from the gaseous substance, a fused salt acceptor, a distillation column and an oil treatment device, wherein the thermal cracking furnace, quenching device, fused salt-separating device, distillation column and oil treatment device are connected in series with pipes, and the fused-salt separating device is connected with the fused salt acceptor and the fused salt mixing zone with other pipes in series. In a preferred embodiment of the present invention, the apparatus has such a structure that the quenching device contains one or more vertical heat-transfer pipes, the outer wall of each heat-transfer pipe is provided with a cooling jacket, whereby when the fluid mixture flows along the inner wall of the heat-transfer pipe, a solidified film of the fused salt is formed on said inner wall and a fluid wet film is formed on the surface of said solidified film, whereby the solidified film is continuously renewed. In another preferred embodiment of the present invention, the fused salt acceptor comprises two chambers, i.e., a settling tank and a circulating pump chamber, or three chambers, i.e., a settling tank, regeneration tank and a circulating pump chamber; the settling tank being provided with a sludge outlet for taking out sludge sediment and an inlet for the fused salt, the regeneration tank being provided with a nozzle for introducing carbon dioxide and steam and an outlet for discharging resulting hydrogen sulfide, and the circulating pump chamber being provided with a fused salt-circulating pump and an outlet for the fused salt.

DETAILED DESCRIPTION OF THE INVENTION

Figure 1:
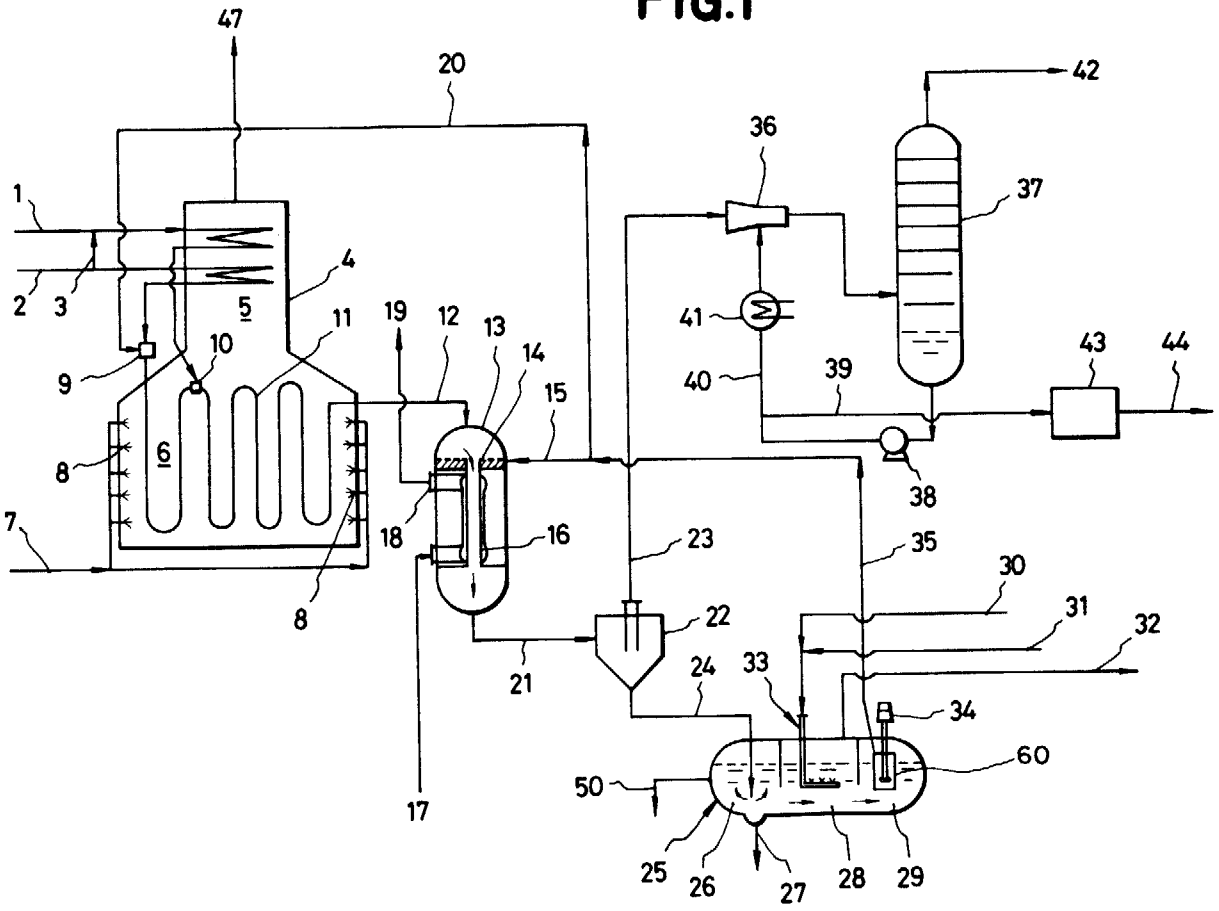
FIG. 1 is a flow sheet for illustrating the present invention.

The present invention will be described with reference to the flow sheet of FIG. 1 and the drawings of FIGS. 2 and 3.

Raw hydrocarbons are fed through an inlet 1 for the raw hydrocarbons and introduced into a convection zone 5 in an upper part of a thermal cracking furnace 4 together with steam introduced through an atomized steam line 3. The raw hydrocarbons thus preheated are introduced into a raw hydrocarbon mixing zone 10. The raw hydrocarbon-mixing zone 10 may be positioned at any suitable part of a reaction tube 11 in the thermal cracking furnace. The raw hydrocarbons and steam are fed into the reaction tube 11 from the zone 10. The raw hydrocarbon-mixing zone 10 is not limited in number, and plural mixing zones 10 may be provided. The reaction tube 11 in the thermal cracking furnace 4 is heated at radiantly heated zone 6 by external heat of a fuel sent through a fuel-feeding line 7 at burners 8. The raw hydrocarbons are thermally cracked by the external heat.

Fused salt is sent via pump 60 driven by motor 34 through steam inlet line 2 via a fused salt circulating line 20. The fused salt is mixed with the steam preheated in the convection zone 5 in a fused-salt mixing zone 9 and then fed into the reaction tube 11.

A distance between the fused salt-mixing zone 9 and the raw hydrocarbon-mixing zone 10 can be determined suitably depending on properties of the starting hydrocarbons, operation conditions such as temperature, mixing ratio of the raw oil to the fused salt and amounts of coke and tar contained in the fused salt to be circulated. Thus, zones 9 and 10 may be positioned at the same portion or, when coke and tar are circulated in large amounts, a heating zone sufficient for the satisfactory gasification of them may be required. Combustion waste gas in the thermal cracking furnace 4 is taken out through a line 47. A fluid mixture of the thermal cracking products, fused salt, steam and so forth is introduced into a quenching device 13 through a delivery line 12. The quenching device 13 has one or more heat transfer pipes 16. In the quenching device 13, a solid film is formed by the fused salt contained in the thermal cracking products and, if necessary, the fused salt is fed through a fused salt-feeding line 15 on the inner wall of the heat-transfer pipe 16 and a wet flowing film is formed thereon.

The heat-transfer pipe 16 in the quenching device 13 is cooled with water fed through a boiler water-feeding line 17. A high pressure steam formed in a steam-forming pipe 18 is taken out through a steam line 19.

The fluid mixture discharged from the quenching device 13 is sent into a fused salt-separating device 22 through a quenching device delivery line 21 and divided into the fused salt and a gaseous substance. The fused salt thus separated contains a part of condensed high boiling products such as coke and tar contained in the thermal cracking product as well as heavy metal suldges and sulfur compounds contained in the raw oil.

Figure 2:
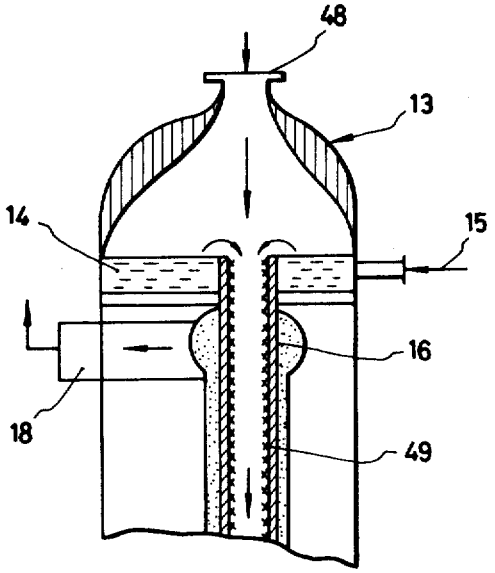
FIG. 2 is a partial cross section of a quenching device usable in the present invention.
Figure 3:
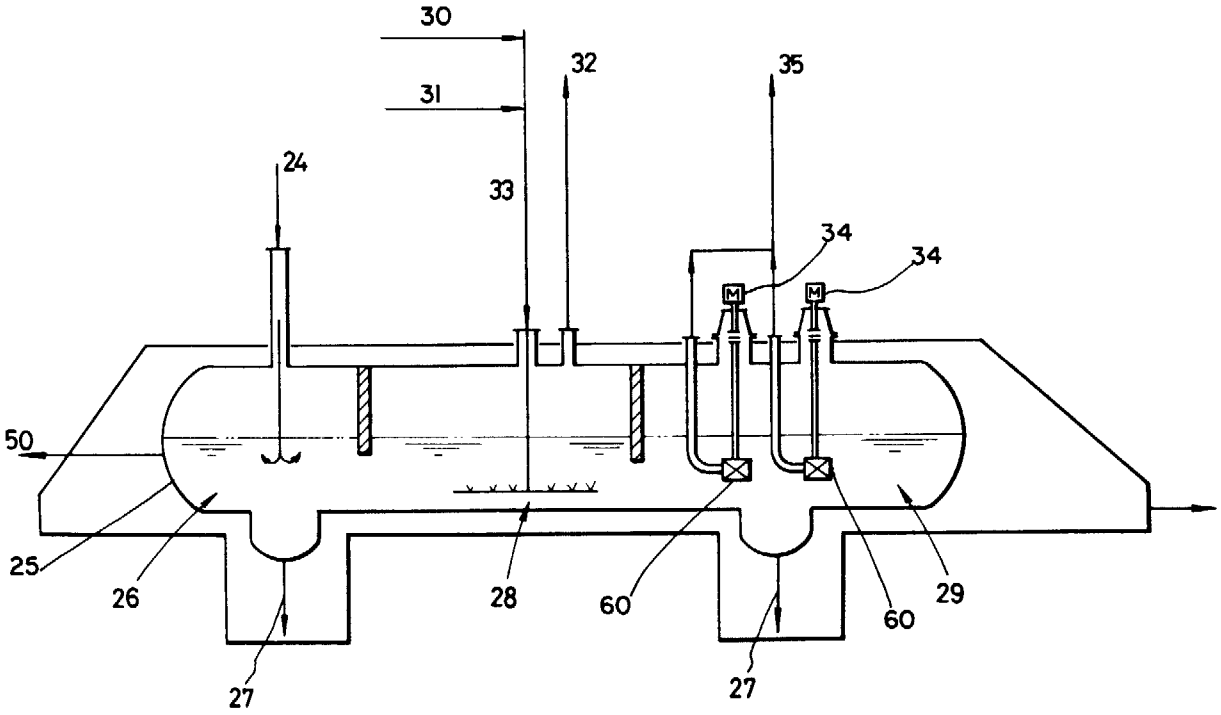
FIG. 3 is a cross section of a fused salt acceptor usable in the present invention.

The fused salt thus separated out is sent into a fused salt-acceptor 25 through a fused salt-delivery line 24 as shown in FIGS. 1 and 3. The fused salt acceptor 25 comprises a settling tank 26, a regeneration tank 28 (if necessary) and a fused salt-circulating pump chamber 29. Those three chambers are connected together at the bottom. A sludge settled at the bottom of the settling tank 26 is taken out through a sludge-discharging line 27. Carbon dioxide and steam introduced through a carbon dioxide-feeding line 30 and a regenerated steam-feeding line 31, respectively, are fed in the regeneration tank 28 through a nozzle 33 to convert sulfur compounds in the raw hydrocarbons reacted with the fused salt to hydrogen sulfide. Hydrogen sulfide thus formed is taken out through a hydrogen sulfide-discharging line 32 to regenerate the fused salt. The fused salt thus regenerated is circulated into the fused salt-mixing zone 9 from the fused salt circulating pump chamber 29 by means of a fused salt-circulating pump 60 through a fused salt-feeding line 35 and said fused salt-circulating line 20 and thereby used again, said pump being driven, as stated supra, by motor 34. A part of the regenerated fused salt is fed into the quenching device 13 through the fused salt-feeding line 15. The condensed high boiling products such as coke and tar contaminating the fused salt can be discharged through a drain 50 of the settling tank 26 or they may be gasified by a suitable means in the settling tank or they may be returned into the fused salt-mixing zone 9 together with the fused salt by means of the fused salt-circulating pump. On the other hand, the gaseous substance separated out in the fused salt-separating device 22 comprises thermal cracking gas, steam, by-produced cracking oil, coke, tarry substance and fused salt mist. The gaseous substance is sent into a quenching oil mixing zone 36 through a separating device outlet line 23, mixed with the quenching oil and thereby cooled and then sent into a distillation column 37. In the distillation column 37, the thermal cracking product is divided into an oil and a thermal cracking gas containing olefins. The thermal cracking gas is taken out from a thermal cracking gas line 42 and introduced into a thermal cracking gas-purification step, wherein olefin gases such as ethylene and propylene are recovered. On the other hand, the oil thus produced and separated out is taken out from the bottom of the distillation column 37 and a part thereof is sent into an oil-treatment device 43 through an oil-discharging line 39 by means of a by-produced oil-introducing pump 38 and the remainder is sent into the quenching oil-mixing part 36 through a quenching oil-circulating line 40 and thereby used by way of circulation. The heat recovery is effected herein with a low pressure steam generator 41. The by-produced cracking oil sent into the treatment device 43 contains coke, tarry substance and fused salt mist. The coke and tarry substance in the by-produced cracked oil are converted to water gas or partially burnt by air or oxygen and thereby recovered as a useful gas. Simultaneously, the fused salt is also recovered. The fused salt thus recovered is taken out through a recovering line 44.

The respective steps of the present invention and functions of the respective devices will be illustrated in detail.

[Thermal cracking furnace]

In the thermal cracking furnace of the present invention, the raw hydrocarbons are thermally cracked to form cracking products. According to the present invention, a tubular thermal cracking furnace is used, which comprises a heating zone wherein a fluid mixture of steam and a fused salt is heated and a reaction zone wherein the fluid mixture of steam and fused salt discharged from the heating zone is mixed with raw hydrocarbons and the mixture is heated to effect the thermal cracking of the raw hydrocarbons. Coke and tar accumulated in the fused salt are removed by the gasification in the heating zone prior to the contact thereof with the raw hydrocarbons. The fluid mixture is mixed with the raw hydrocarbons in the reaction zone. The raw hydrocarbons are thermally cracked in the reaction tube in the thermal cracking furnace.

As the raw hydrocarbons used in the present invention, there may be mentioned natural gas, naphtha, kerosine, gas oil, crude oil, atmospheric distillation residue and vacuum residue oils. The present invention is effective particularly for the thermal cracking of hydrocarbon fractions of, for example, crude oil kerosine, gas oil, heavy oil and asphalt oil.

The fused salt used in the present invention may be any of fused salts having functions required in the present invention. Preferred fused salts are those having a melting point of 200°-700° C. and a viscosity of 1-100 cP. The fused salt exhibits a catalytic effect in the conversion of by-produced coke into water gas and preferably an effect of preventing the deposition of coke and tarry substance on the inner walls of the reaction tube and other devices. As concrete examples of the fused salts, there may be mentioned oxides, hydroxides, carbonates, chlorides and mixed salts of alkali metals and alkaline earth metals. Particularly preferred fused salts include alkali metal carbonates such as lithium carbonate, sodium carbonate and potassium carbonate. They may be used alone or in the form of a mixture of two or more of them or an eutectic mixture of them.

Amount of the fused salt to be fed is preferably 0.01-10 times as great by weight as the raw hydrocarbons. The amount of the fused salt may be varied depending on properties, particularly Conradson carbon residue, of the raw hydrocarbons. The fused salt is used in a relatively small amount in the treatment of light fractions such as naphtha, kerosine and gas oil and it is used in a relatively large amount in the treatment of heavy fractions such as vacuum residue. More concretely, it has been known that coke formed by the thermal cracking is generally increased in amount as Conradson carbon residue contained in the raw oil is increased. As compared with a case of using heavy oils such as naphtha, kerosine and gas oil, coke is formed in a larger amount in case heavy oils such as crude oil, topping residue and vacuum residue are thermally cracked, since Conradson carbon residue in the raw oil is larger in the latter case.

Therefore, it is preferred that amount of the fused salt introduced during the thermal cracking for preventing the deposition of coke formed in the craction tube on the wall thereof and for eliminating coking troubles by conversion of coke to water gas is varied depending on amount of the coke formed. The larger Conradson carbon residue in the raw oil, the larger the amount of fused salt.

If amount of the fused salt fed is insufficient, a satisfactory catalytic effect in the conversion of the formed coke into water gas or effect of preventing the deposition of coke on the wall of the reaction tube cannot be expected. On the other hand, an excessive amount of the fused salt is uneconomical and causes various problems to do with safety and operation.

Amount of the fused salt to be actually fed into the reaction tube must be determined depending on amount of the flowing gas which forms the circular flow or circular atomized flow and physical properties thereof. From Baker's phase diagram (The Oil and Gas Journal, 1954, 53, 185) showing flowing conditions of gas-liquid mixture stream in a horizontal tube and Golan's phase diagram (Proc. Ind. Mech. Engrs., 1969-1970, 184, Pt. 3C, 108) showing flowing conditions of gas-liquid mixture stream in a vertical tube and after experiments on water-air mixture, the inventors have found that the circular flow or circular atomized flow is formed when mass velocity of the cracking gas and steam is 20-160 $kg/cm^2.sec$ and amount of the fused salt fed in the reaction tube is 0.01-10 times as much by weight as the raw hydrocarbons or 1-400 times as much by weight as Conradson carbon residue of the raw oil.

Steam is used according to the present invention for the purpose of reducing partial pressure of the thermal cracking product and also performing the reaction according to the reaction formulae shown below for conversion of by-produced coke and tarry substance into water gas (endothermic reaction). Amount of steam to be fed is preferably 0.2-5 times, more preferably 0.5-3 times, as great by weight as the raw hydrocarbons.

$$C + 2H_2O \rightarrow CO_2 + 2H_2$$

$$C + H_2O \rightarrow CO + H_2$$

The sum of the raw hydrocarbons and steam to be introduced in the reaction tube is preferably 2–160 $kg/m^2.sec$.

The raw hydrocarbons accompanied with atomized steam is preheated to about 400° C. in the convection zone in the thermal cracking furnace and then sent into the reaction tube. Steam used for the dilution is also preheated to at least about 400° C. in the convection zone and sent into the mixing zone wherein it is to be mixed with the fused salt. Steam and the fused salt thus mixed are introduced into the reaction tube and heated in a radiation zone in the thermal cracking furnace, whereby coke contained in the fused salt is converted to water gas. The fluid mixture is further mixed with said mixture of raw hydrocarbons and steam to effect the thermal cracking of the raw hydrocarbons. Thermal cracking temperature is preferably 700°–900° C., particularly 720°–850° C. The raw hydrocarbons are thus thermally cracked to form inorganic gases such as $H_2$, CO, $CO_2$ and $H_2S$, lower olefins such as ethylene and propylene, $C_4$ fraction, $C_5$ fraction, BTX-containing aromatic hydrocarbons, by-produced cracking oil, coke and tarry substance. If the raw hydrocarbons contain sulfur compounds, a part of the sulfur compounds is converted to gaseous $H_2S$, another part thereof is included in the by-produced cracking oil and the remainder reacts with the fused salt. If the fused salt is an alkali metal (hereinafter referred to as M) carbonate, it reacts with the sulfur compounds contained in the raw hydrocarbons to exhibit desulfurization effect as follows:

$$M_2CO_3 + H_2S \rightarrow M_2S + CO_2 + H_2O$$

Sulfur contained in the raw hydrocarbons is partially moved into the cracking gas as $H_2S$, partially left in the by-produced cracking oil as sulfur compounds and mostly reacted with the fused salt and thereby desulfurized, through behavior of the sulfur varies depending on amount thereof. By-produced coke and tar are gasified by the reaction with steam. Alkali metal salts or alkaline earth metal salts are most preferred as the fused salt, since they exhibit the greatest catalytic capacities in the reaction. The thermal cracking furnace used in the present invention is a tubular furnace of external heating type.

As methods for supplying reaction heat required of the thermal cracking, there may be mentioned heat medium method, high temperature combustion waste gas method and external heating method. However, the heat medium method has problems of safety and operation. According to the high temperature combustion waste gas method, there is a fear that the thermal cracking proceeds excessively, since the raw oil is contacted with the high temperature gas, whereby a large amount of coke is formed and the effect of the fused salt of preventing the coke deposition on the wall of the reaction tube cannot be expected. According to the external heating method, said excessive thermal cracking can be avoided and amount of the fused salt kept in the reaction system is far smaller than that of the heat medium method.

Diameter of the reaction tube is preferably ½–8 inches, particularly 2–6 inches. Length of the reaction tube is determined suitably depending on quantity of heat supplied through the burners, residence time of the cracking gas in the reaction tube and amount of coke incorporated in the fused salt.

The amount of by-produced coke varies depending on properties of the raw hydrocarbons, whereby the amount of coke included in the fused salt also varies. Therefore, the treatment of all sorts of the raw materials is possible by altering the position of the inlet for the raw hydrocarbons in the reaction tube without necessitating an additional device for the treatment of coke. For example, raw materials containing light fractions which by-produce a small amount of coke can be treated in the apparatus shown in FIG. 1 in which the distance between the fused salt-mixing zone 9 and the raw hydrocarbon-mixing zone 10 is made relatively short in the reaction furnace, and raw materials containing heavy fractions which by-produce a large amount of coke can be treated in the same apparatus in which said distance is made relatively long. In carrying out the process of the present invention, the reaction tube can be divided into suitable paths, the paths can be provided with suitable flow control devices which control the supply of the raw hydrocarbons and, in addition, position of raw material inlet of the reaction tube in the cracking reaction zone can be altered depending on properties of the raw hydrocarbons.

As the fused salt, there may be used an alkali metal carbonate or the like as described above. If, for example, an equimolar mixture of $Na_2CO_3$—$K_2CO_3$—$Li_2CO_3$ is used, there is a great difference in properties of the catalyst for the conversion into water gas from a case wherein a fused metal per se is used. Namely, coke formed by the thermal cracking in the reaction tube is prevented from deposition on the wall of the reaction tube by a liquid film of the fused salt formed on the inner wall of the reaction tube and coke is completely consumed in the reaction with steam flowing in the reaction tube to form hydrogen, carbon monoxide and carbon dioxide. Consequently, coke formation in the quenching heat exchanger is prevented, heat recovery is facilitated and properties of by-produced cracking oil are made favorable.

[Quenching device]

The fluid mixture of the cracking products, fused salt and steam discharged from the reaction tube is introduced in the quenching device and cooled therein to about 400°–650° C. for inhibiting a second-order reaction of the cracking products and for heat recovery. By-produced coke does not deposit on the inner wall of the heat transfer pipes in the quenching device, since it is coated with a solidified film of the fused salt which is continuously renewed by the fused salt introduced therein in the form of said mixture and the fused salt newly introduced according to need.

An embodiment of the present invention will be illustrated with reference to FIGS. 1 and 2. The fluid mixture is sent into the quenching device 13 through an inlet 48 for the cracking products and then introduced into the heat transfer pipe 16. The heat transfer pipe 16 is cooled by cooling water fed through the boiler water-feeding line 17. High pressure steam thus formed is taken out through the steam line 19 to recover heat. A fused salt reservoir 14 is provided in an upper part of the quenching device 13 for temporarily storing the fused salt contained in the fluid mixture and the fused salt fed as needed through the fused salt-feeding line 15. The fused salt overflows into the heat transfer pipe 16. However, the reservoir 14 is not limited to this type. Namely, a role of the fused salt reservoir 14 is to allow the fused salt-containing fluid mixture to flow uniformly through the heat transfer pipe. The fused salt reservoir 14 may be omitted and a suitable dispersion plate or the like may be inserted therein to effect the uniform dispersion. The most important matter is, therefore, the formation of the film of the solidified, fused salt on the inner wall thereof and a wet flowing film thereon. When the fluid mixture is cooled by the steam formation in the heat transfer pipe, the inner wall of the heat transfer pipe is wetted by the fused salt. For example, if 120 kg/cm$^2$ of steam is formed, the temperature is 320° C. and a thin solidified film of the fused salt is formed on the inner wall of the heat transfer pipe. The solidified film prevents the deposition of coke and tar on the inner wall, through it damages the heat transfer. Temperature of the surface of the solidified film is made higher by the cracking products, whereby the fused state is maintained and the solidified film is continuously renewed.

If only the wet flowing film is formed without forming the solidified film on the surface, there is a fear that coke or tarry substance is directly contacted with the inner wall of the heat transfer pipe. If coke or tarry substance once adheres to the inner wall, it can no more be removed. However, if the solidified film is formed and it is continuously renewed, coke and tarry substance once adhered thereto can be removed easily. When the raw hydrocarbons contain a large amount of heavy fractions, it is advantageous to supply an additional amount of the fused salt as described above. When the raw hydrocarbons contain a small amount of heavy fractions, means for separating out the fused salt may be provided ahead the quenching device.

Thickness of the solidified film is varied depending on temperature of the cracking products at the outlet of the quenching device and also temperature of steam obtained by the heat recovery. Thus, so-called carbon troubles caused in the thermal cracking of heavy oil-containing raw materials and heat recovery in conventional techniques can be overcome and a long time operation is made possible by providing the quenching device.

[Fused salt separating device]

The fluid mixture of the cracking products, steam and fused salt discharged from the quenching device is sent into the fused salt-separating device wherein it is divided into the fused salt and a gaseous substance. It is desirable that the separating device has as high an efficiency as possible so that the mist of fused salt is not entrained on the gaseous substance as much as possible. The separating device may be of an ordinary cyclone type.

When the fluid mixture passes through the quenching device and the fused salt-separating device, temperature thereof is 400°-650° C. Among the cracking products, a part of coke and high boiling products is included in the fused salt. The amount of the inclusion is increased as the raw hydrocarbons become heavier.

[Fused salt acceptor]

The acceptor comprises three chambers, i.e., settling tank, regeneration tank and fused salt-circulating pump chamber.

The settling chamber has functions of settling metal substances and sludges in the raw hydrocarbons which contaminate the fused salt and taking out thus settled precipitates from the bottom thereof.

The regeneration tank has a function of regenerating and thereby recovering sulfur compounds contained in the raw hydrocarbons after they are reacted with the fused salt. The reaction product of sulfur and the fused salt (e.g., an alkali metal carbonate, the alkali metal being referred to as M) is represented by the formula: $M_2S$. An increase in this sulfur compound is undesirable when the fused salt is circulated, since it elevates melting point and viscosity. In the regeneration tank, $CO_2$ and $H_2O$ are introduced to recover $M_2S$ and $H_2S$ as follows:

$$M_2S + CO_2 + H_2O \rightarrow M_2CO_3 + H_2S \uparrow$$

This reaction is exothermic. Temperature in the tank is controlled by changing temperatures of $CO_2$ and $H_2S$ to be fed. Reaction temperature is preferably 400°-650° C.

Concentration of the sulfur compounds in the fused salt varies depending on sulfur content of the raw hydrocarbons. For example, if low sulfur hydrocarbons such as naphtha, kerosine and Minas crude oil are used, the fused salt contains a small amount of sulfur compounds, since water gas-forming reaction occurs to form $CO_2$ in the thermal cracking zone. Further, in the presence of the diluting steam, the sulfur compounds in the fused salt reach the equilibrium by said regeneration reaction. Thus, the regeneration tank is not always required. Residence time of the fused salt in the tank and amounts of $CO_2$ and $H_2O$ to be fed are altered depending on sulfur content of the raw hydrocarbons.

The circulating pump chamber is required for the circulation of the fused salt. The pump used herein may be of any type. For example, an ordinary vertical centrifugal pump may be used. Condensed high boiling products such as coke and tar included in the fused salt can be discharged through a drain of the settling tank, gasified by a suitable means in the settling tank or returned into the fused salt-mixing zone by means of a fused salt-circulating pump.

[Quenching oil-mixing zone]

The gaseous substance separated out from the fused salt in the fused salt-separating device has a temperature of generally 400°-650° C. The gaseous substance comprises the thermal cracking gas, steam, by-produced cracking oil, coke, tar and fused salt mist. The gaseous substance is sent into the quenching oil-mixing zone for separating out the by-produced cracking oil, coke, tar and fused salt mist and also for recovering heat. The quenching oil-mixing zone has functions of cooling the gaseous substance by mixing the same with the by-produced cracking oil (quenching oil), feeding the mixture smoothly into the distillation column arranged downstream, preventing trouble caused by the condensation of coke, tar and fused salt mist contained in the gaseous substance on the walls of the pipe of the lines and the distillation column, and exhibiting an effect of cleaning the lines. Heat is recovered herein by the formation of low pressure steam.

[Distillation column]

In the distillation column, oil is recovered from the mixture sent from the quenching oil-mixing zone and the thermal cracking gas is also recovered. The thermal cracking gas is then sent to a step of separating olefins. On the other hand, the by-produced cracking oil is recovered at the bottom of the column and sent into said quenching oil-mixing zone for the use as the quenching oil. The by-produced cracking oil is thus circulated. A part of the cracking oil formed in a large quantity is taken out and sent into the coil treatment device. If necessary, low boiling and medium boiling oils may be taken out through side cut lines (not shown).

[Oil treatment device]

The by-produced cracking oil sent into the oil treatment device contains coke, tarry substance and fused salt mist.

Generally, the by-produced cracking oil is used as a fuel oil. In this case, however, the fused salt contained therein makes difficult the use of the oil as fuel oil. Therefore, the coke, tarry substance and fused salt mist are separated out from the oil by the extraction, distillation or the like. The oil thus obtained is used as an ordinary fuel. On the other hand, the mixture of the coke, tarry substance and fused salt mist is converted to water gas by steam or subjected to partial combustion treatment with air or oxygen to recover useful gases of $H_2$ and CO and the fused salt. Further, sensible heat thereof is recovered by means of the steam formation. Thus, the oil is completely treated.

Those treatments can be effected easily without necessitating any special gasification catalyst, since the fused salt contained in the mixture has a powerful catalytic effect in the conversion into water gas or in the partial combustion.

According to the present invention, olefins such as ethylene and propylene can be obtained efficiently from any sort of raw hydrocarbons including both heavy and light fractions by overcoming the defects of conventional processes and apparatus while their merits are maintained. Namely, not only raw hydrocarbons comprising light fractions but also those comprising heavy fractions can be thermally cracked continuously without causing carbon trouble.

According to the present invention, coking trouble can be overcome by forming a liquid film of the fused salt along the wall of the reaction tube and passing gaseous components, i.e., the cracking gas and diluting steam through the tubular liquid film in so-called circular flow or circular atomized flow. Thus, by the formation of the liquid film of the fused salt along the wall of reaction tube, the deposition of coke formed by the thermal cracking on the wall of the reaction tube is prevented. Therefore, the thermal cracking can be carried out continuously with a high heat transfer to the reaction tube without causing clogging of the reaction tube. As for means of the thermal cracking, the reaction tube of external heating type is used in the present invention as described above. Given amounts of the fused salt and steam are introduced in the reaction tube together with the raw oil. According to the present invention, the production of olefins such as ethylene and propylene by the thermal cracking of heavy oil in the reaction tube of external heating type is made possible by controlling flow rates of the gaseous and liquid components, taking advantages of properties of the gaseous and liquid components though it has been considered to be difficult in the prior art. Moreover, the amount of the fused salt required is limited to just enough to wet the wall and, even if in only a small amount, the fused salt can act as a powerful catalyst for the water-gas formation reaction, therefore the present invention is possessed of a further merit of effectively preventing coking trouble from occurring with use of only a small amount of the fused salt.

Further, since fused salt is used, the apparatus is not damaged and the thermal cracking of heavy hydrocarbons can be carried out in the same manner as the thermal cracking of light hydrocarbons. The reaction tube can be operated by the same techniques used when operating a conventional tubular furnace of the external heating type to crack naphtha. Heavy hydrocarbons can be treated easily to realize a high yield without necessitating the supplementation of the fused salt, and continuous operation over a long period is possible.

The amount of the fused salt kept in the apparatus is minimized, since heat required for the thermal cracking is provided by the external heating system. This is advantageous from the viewpoints of safety and health.

In addition, as compared with conventional thermal cracking methods, coke formation is reduced in the reaction tube and on the inner wall of the quenching device. Consequently, the amount of fused salt required to prevent coke deposition in the reaction tube and on the inner wall of the quenching pipe is reduced.

The following examples further illustrate the present invention, which by no means limit the invention.

EXAMPLE 1

Experiments of the thermal cracking of raw hydrocarbons were carried out for the production of a cracking gas rich in olefins such as ethylene and propylene in the thermal cracking furnace shown in FIG. 1 which was heated by an electric heating system.

Experiment conditions were as shown below:

| | |
|---|---|
| Diameter of reaction tube: | ½ inch |
| Length of reaction tube: | 20 m |
| Feed of raw hydrocarbons: | 4–6 kg/hr. |
| Steam: | 3.5–5 kg/hr. |
| Cracking temperature: | 750–900° C. |
| Quenching temperature: | 420–600° C. |
| Temperature of fused salt-separating device: | 550° C. |
| Temperature of settling tank: | 550° C. |
| Temperature of regeneration tank: | 550° C. |
| Temperature of fused salt-circulating pump: | 550° C. |
| Temperature of quenching oil-mixing zone: | 180–200° C. |

The results obtained by varying raw materials, composition of the fused salt and feed of the fused salt are shown in Table 1.

TABLE 1

| Experiment | 1 | 2 | 3 | 4 | 5 | 6 (Comparative) | 7 (Comparative) |
|---|---|---|---|---|---|---|---|
| Raw hydrocarbons | Minas crude oil | Minas crude oil | Arabian Light crude oil | Arabian Light vacuum residue | Kerosine | Minas crude oil | Kerosine |
| Composition of fused salt* | A | B | C | A | A | A | — |
| Feed of fused salt | 5 | 5 | 3.5 | 5 | 0.1 | 0.04 | 0 |

TABLE 1-continued

| Experiment | 1 | 2 | 3 | 4 | 5 | 6 (Comparative) | 7 (Comparative) |
|---|---|---|---|---|---|---|---|
| (kg/HR) Results | Continuous operation was possible for 200 hrs. No regeneration | | Continuous operation was possible for 200 hrs. Regeneration. | Coke was formed. Continuous operation was possible. | Continuous operation was possible for 10 hrs. | Reaction tube and quenching device were clogged after 3 hrs. | Reaction tube and quenching device were clogged after 15 hrs. |

*A: Equimolar mixture of $K_2CO_3$, $LiCO_3$ and $Na_2CO_3$
B: Composition A added with 10 wt.% of $CaCO_3$
C: Composition A added with 10 wt.% of $CaCl_2$

What we claim is:

1. In a process for thermal cracking raw hydrocarbons in the presence of steam and a fused salt to produce an olefin-containing fluid mixture, said process comprising: feeding a fused salt, steam and raw hydrocarbons into a reaction tube of a thermal cracking furnace of external heating type to thermally crack the raw hydrocarbons; passing the resulting fluid mixture comprising cracked products, fused salt and steam through a vertically disposed quenching zone having an inner wall with an inner wall surface and an outer wall, to quench the fluid mixture; separating the resulting quenched fluid mixture into a fused salt component and a gaseous component; purifying the separated fused salt component by removing sludge therefrom; recirculating the resulting purified fused salt to the reaction tube; and separating and recovering olefin-containing gas from the gaseous component, the improvement comprising:
   (a) admixing steam and the purified fused salt and injecting the resulting steam-fused salt mixture into the reaction tube through a first inlet;
   (b) admixing steam and raw hydrocarbons and injecting the resulting steam-raw hydrocarbon mixture into the reaction tube through a second inlet positioned downstream of the first inlet;
   (c) passing the fluid mixture downward along the inner wall surface of the quenching zone while simultaneously passing purified molten salt downward along said surface to prevent the accumulation of a coke deposit in the quenching zone.

2. A process for the thermal cracking according to claim 1, wherein the fused salt is a fused metal salt having a melting point of 200°-700° C. and a melt viscosity of 1-100 cP.

3. A process according to claim 1 or 2, wherein the metal salt is a compound or a mixture of compounds selected from the group consisting of oxides, hydroxides, carbonates and chlorides of alkali metals and alkaline earth metals.

4. A process according to any of claims 1 or 2, wherein the fused salt is used in an amount 0.01-10 times as great as the amount of the raw hydrocarbons.

5. A process according to any of claims 1 or 2, wherein steam is used in an amount 0.2-5 times as great as the amount of the raw hydrocarbons.

6. A process according to claim 3 wherein the fused salt is used in an amount 0.01-10 times as great as the amount of the raw hydrocarbons.

7. A process according to claim 3 wherein steam is used in an amount 0.2-5 times as great as the amount of the raw hydrocarbons.

8. A process according to claim 4 wherein steam is used in an amount 0.2-5 times as great as the amount of the raw hydrocarbons.

9. The process of claim 1 in which sulfur compounds are removed from the separated fused salt component.

10. In an apparatus for thermal cracking raw hydrocarbons in the presence of steam and a fused salt to produce a fluid mixture comprising an olefin-containing cracked gas, steam and fused salt, said apparatus comprising:
   (a) a tubular thermal cracking furnace of external heating type having: (i) an upstream section, (ii) a downstream section, (iii) a first inlet port in the upstream section; (iv) a second inlet port in the upstream section downstream of the first inlet port, and (v) an outlet port in the downstream section;
   (b) quenching means for quenching the fluid mixture, said quenching means comprising: (i) a vertically disposed heat transfer pipe having (I) an upper section, (II) a lower section, (III) an inner wall, (IV) an outer wall, (V) a fluid mixture inlet port communicating with the outlet port of the tubular furnace for receiving fluid mixture therefrom, (VI) a fused salt inlet port, and (VII) a quenched fluid mixture outlet port; and (ii) cooling means surrounding the outer wall of the heat transfer pipe;
   (c) a fused salt separator for separating quenched fluid mixture into fused salt and gaseous material, said fused salt separator having: (i) a fused salt outlet port, (ii) a gaseous materials outlet port, and (iii) a quenched fluid mixture inlet port communicating with the quenched fluid mixture outlet port of the quenching means for receiving quenched fluid mixture therefrom;
   (d) gas separating and recovering means for separating and recovering olefin-containing cracked gas from the gaseous material, the gas separating and recovering means communicating with the gaseous material outlet port of the fused salt separator for receiving the gaseous material therefrom; and
   (e) a fused salt acceptor for removing sludge from separated fused salt and recirculating fused salt, said fused salt acceptor having (i) an inlet port communicating with the fused salt outlet port of the fused salt separator for receiving fused salt therefrom, (ii) a sludge discharge port for discharging sludge, (iii) a fused salt outlet port for recirculating fused salt;

the improvement wherein the apparatus comprises:
   (A) a fused salt mixing means having: (i) a steam inlet port communicating with a steam source for receiving steam therefrom, (ii) a fused salt inlet port communicating with the fused salt outlet port of the fused salt acceptor for receiving fused salt therefrom, and (iii) an outlet port communicating with the first inlet port of the tubular furnace for feeding mixed steam and fused salt into the tubular furnace;

(B) a raw hydrocarbon mixing means for mixing raw hydrocarbons and steam, the raw hydrocarbon mixing means having: (i) a steam inlet port communicating with the steam course, (ii) a raw hydrocarbon inlet port communicating with a raw hydrocarbons source, and (iii) an outlet port communicating with the second inlet port of the tubular furnace for feeding mixed raw hydrocarbons and steam into the tubular furnace; and (C) the fluid mixture inlet port and the fused salt inlet port of the quenching means being positioned in the upper section of the heat transfer pipe, the fused salt inlet port communicating with the fused salt outlet port of the fused salt acceptor for receiving fused salt therefrom, and the quenched fluid mixture outlet port being positioned in the lower section of the heat transfer pipe to provide downward flow of fluid mixture and fused salt through the heat transfer pipe.

11. An apparatus according to claim 10, wherein the fused salt acceptor comprises two chambers, a settling tank and a circulating pump chamber or three chambers, a settling tank, a regeneration tank and a circulating pump chamber, the settling tank being provided with a sludge outlet for taking out sludge sediment and an inlet for the fused salt, the regeneration tank being provided with a nozzle for introducing carbon dioxide and steam and an outlet for discharging resulting hydrogen sulfide, and the circulating pump chamber being provided with a fused salt-circulating pump and an outlet for the fused salt.

* * * * *